US006580344B2

(12) United States Patent
Li

(10) Patent No.: US 6,580,344 B2
(45) Date of Patent: Jun. 17, 2003

(54) GROUND FAULT INTERRUPTION RECEPTACLE

(75) Inventor: Chengli Li, Chongqing (CN)

(73) Assignee: Huadao Huang, Wenzhou (CN)

( * ) Notice: Subject to any disclaimer, the term of this patent is extended or adjusted under 35 U.S.C. 154(b) by 197 days.

(21) Appl. No.: 09/785,886

(22) Filed: Feb. 15, 2001

(65) Prior Publication Data

US 2003/0016477 A1 Jan. 23, 2003

(30) Foreign Application Priority Data

Sep. 4, 2000 (CN) ..... 00250313 U

(51) Int. Cl.[7] ..... H01H 73/00

(52) U.S. Cl. ..... 335/18; 361/42; 361/93.1; 361/102

(58) Field of Search ..... 335/18; 361/42–50, 361/93.1, 93.6, 102

(56) References Cited

U.S. PATENT DOCUMENTS 4,237,435 A 12/1980 Cooper et al. ..... 335/18

5,594,398 A * 1/1997 Marcou et al. ..... 335/18

* cited by examiner

*Primary Examiner*—Ramon M. Barrera
(74) *Attorney, Agent, or Firm*—Ying Tuo

(57) ABSTRACT

A new and improved type of ground fault interruption receptacle is mainly consists of an upper housing, a middle supporter and a lower holder. Two sets of female power-output socket 5, 6, a simulation test button (i.e. test button for fault detecting) and a reset button are disposed on the upper housing. A metal mounting plate is disposed between the upper housing and the middle supporter. At the two sides of the middle supporter is disposed a pair of metal conductors. Between the middle supporter and the lower holder is disposed a printed circuit board, and thereon a differential transformer within which an iron core is inserted, a reset guide member and a flat spring type of resilient off locking switch are arranged. Using the differential transformer and the resilient off locking switch, the receptacle of the present invention may detect whether the fault current exists and whether the damage of a certain element or member for power transmission occurs. If so, the receptacle of the present invention can electrically disconnect the power-out connectors with the relevant power-input connectors so as to accomplish the ground fault interruption.

8 Claims, 8 Drawing Sheets

GROUND FAULT INTERRUPTION RECEPTACLE

FIELD OF THE PRESENT INVENTION

The present invention generally relates to a receptacle with ground fault interruption function, and more specially, to a receptacle with ground fault interruption function which is suitable to be mounted into ordinary walls.

BACKGROUND OF THE PRESENT INVENTION

With people's living standard continuously rising and household electrical appliances being daily-increasingly popularized, the consumer demands that some electrical receptacles be pre-installed in walls when their houses are being built. However, at the present time, most of the electrical receptacles embedded in the walls are ordinary electrical receptacles and do not have ground fault interruption function. Although some of the electrical receptacles, for example, as those disclosed in U.S. Pat. No. 4,237,435 and in U.S. Pat. No. 4,247,840, have ground fault interruption function, they still have the following shortcomings:

(1) The electrical receptacle disclosed in U.S. Pat. No. 4,237,435 and in U.S. Pat. No. 4,247,840 will be cut-off immediately, when some component in operation is damaged. But its power input and output terminals might still be electrically connected to power source when the reset button of the receptacle is pushed down to reset the receptacle.

(2) In installing such an electrical receptacle, the installing worker can wrongfully connect the power source input terminal with the power source output terminal in the receptacle because the installing worker is unable to correctly distinguish between the power input terminal and the power output terminal, thereby connecting the power input terminal with receptacle's output terminal and connecting the power output terminal with receptacle's input terminal. Under such a condition, the receptacle with ground fault interruption function can still connect its input and output terminals with the power source. Under this condition, not only the electrical receptacle is unable to perform ground fault interruption function, it also misguides the users to continuously use this wrongfully connected receptacle. Thus it may cause harm to the users and damages and the household electrical appliances.

The object of the present invention is to provide a new and improved receptacle that is suitable to be installed within ordinary walls and ordinary wall outlet boxes. Even when a component in the receptacle is damaged or a wrongful connection, as above described, is made. This receptacle can still prevent the power input from being connected to power output.

SUMMARY OF THE INVENTION

To achieve the above-described objective, the receptacle of the present invention comprises:

an upper housing 2, a middle supporter 3 and a lower holder 4;

a metal mounting plate 1 disposed between said middle supporter 3 and said upper housing 2;

a printed circuit board 18, thereon are disposed a differential transformer 19, a reset guide member 28;

a solenoid 26 within which an iron core is inserted;

a flat spring type of resilient off locking switch 37 made of resilient metal material and disposed between the reset guide member 28 and said printed circuit board 18;

a contact 38 positioned corresponding to said protruded circular spot 39.

a longitudinally central through hole 29 formed within said reset guide member 28;

a movable L-shaped metal latch member 30 disposed under said reset guide member 28, and a position-limiting pin 32 for limiting the displacement of said L-shaped metal latch member 30 disposed at one end of said latch member 30;

a central aperture 31 formed at the horizontal part of said latch member 30;

a locking guide plunger 35, a flat surface 41 formed at the bottom end of said locking guide plunger 35, and a locking recess 36 formed near the under part of said locking guide plunger 35;

a spring member 91 worn over the upper part of said locking guide plunger 35, and one end of said spring member 91 inserted within a reset button 8;

one end of said of resilient locking switch 37 is welded or soldered on said printed circuit board 18 and a protruded circular spot 39, formed by punching, is disposed on the another end of said locking switch 37; and a contact 38 placed corresponding to said protruded circular spot 39; and through said differential 19, both ends of said off locking switch 37 are connected to their respective the neutral lines of the power-input connectors 9, 10 and power-output connectors 109, 110.

By using the above-described arrangement, the present invention provides more reliable protection to consumer and appliance in installing and using the ground fault interruption receptacle.

BRIEF DESCRIPTION OF THE DRAWINGS

The advantages of the present invention will become apparent to those skilled in the art after reading the following specification and by reference to the drawings which.

DETAILED DESCRIPTION OF THE PRESENT INVENTION

Figure 1:
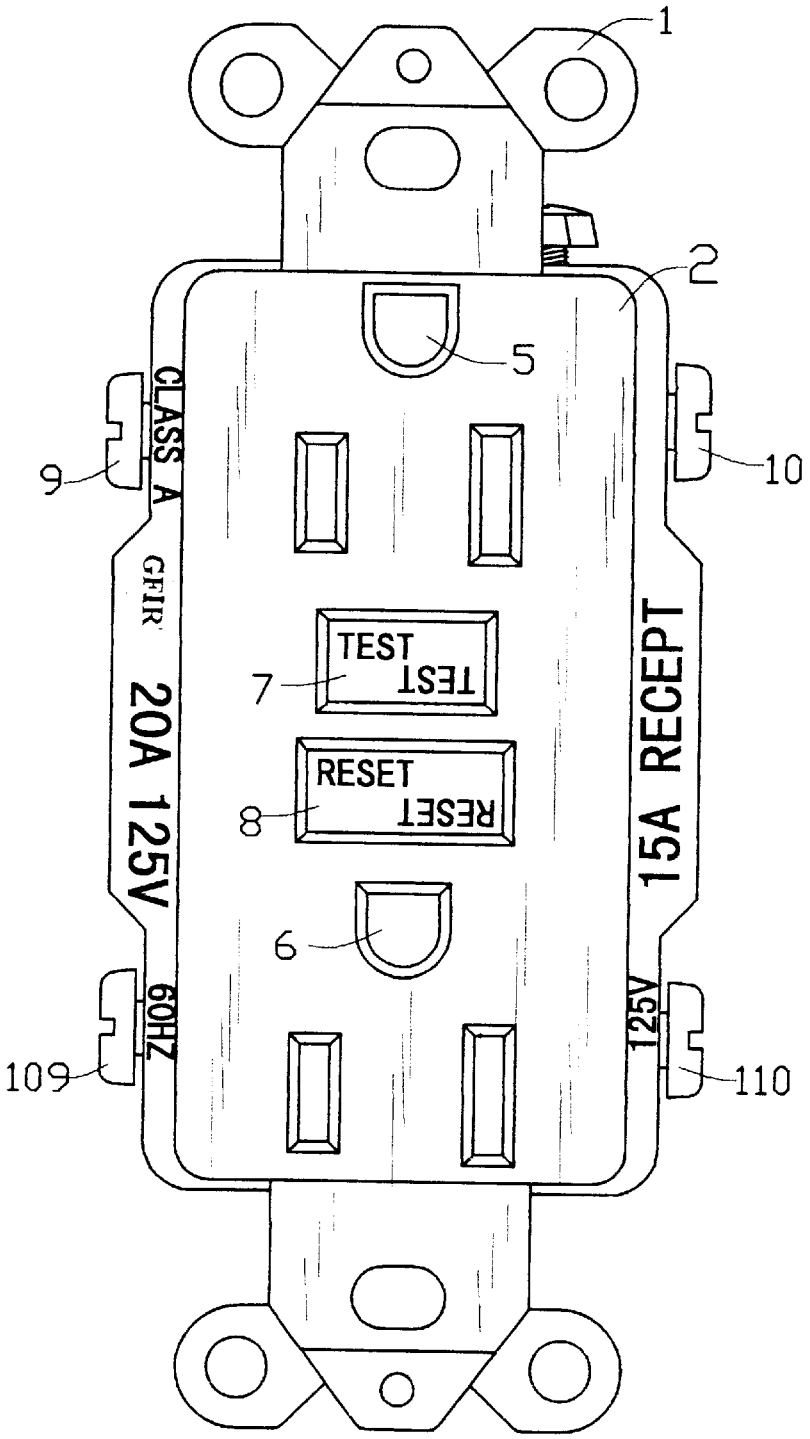
FIG. 1 is an elevational view of the receptacle of the present invention.

As shown in FIGS. 1 to 4 is an embodiment of the present invention. It mainly consists of an upper housing 2, a middle supporter 3 and a lower holder 4. In addition, between the upper housing 2 and the middle supporter 3 is mounted a metal mounting plate 1; and mounted between the middle supporter 3 and the bottom the lower holder 4 is a printed circuit board 18.

On the upper housing 2 are mounted two sets of female power-output socket 5, 6 used for receiving conventional male plug, a simulation test button 7 (TEST) and a reset button 8 (RESET).

Figure 2:
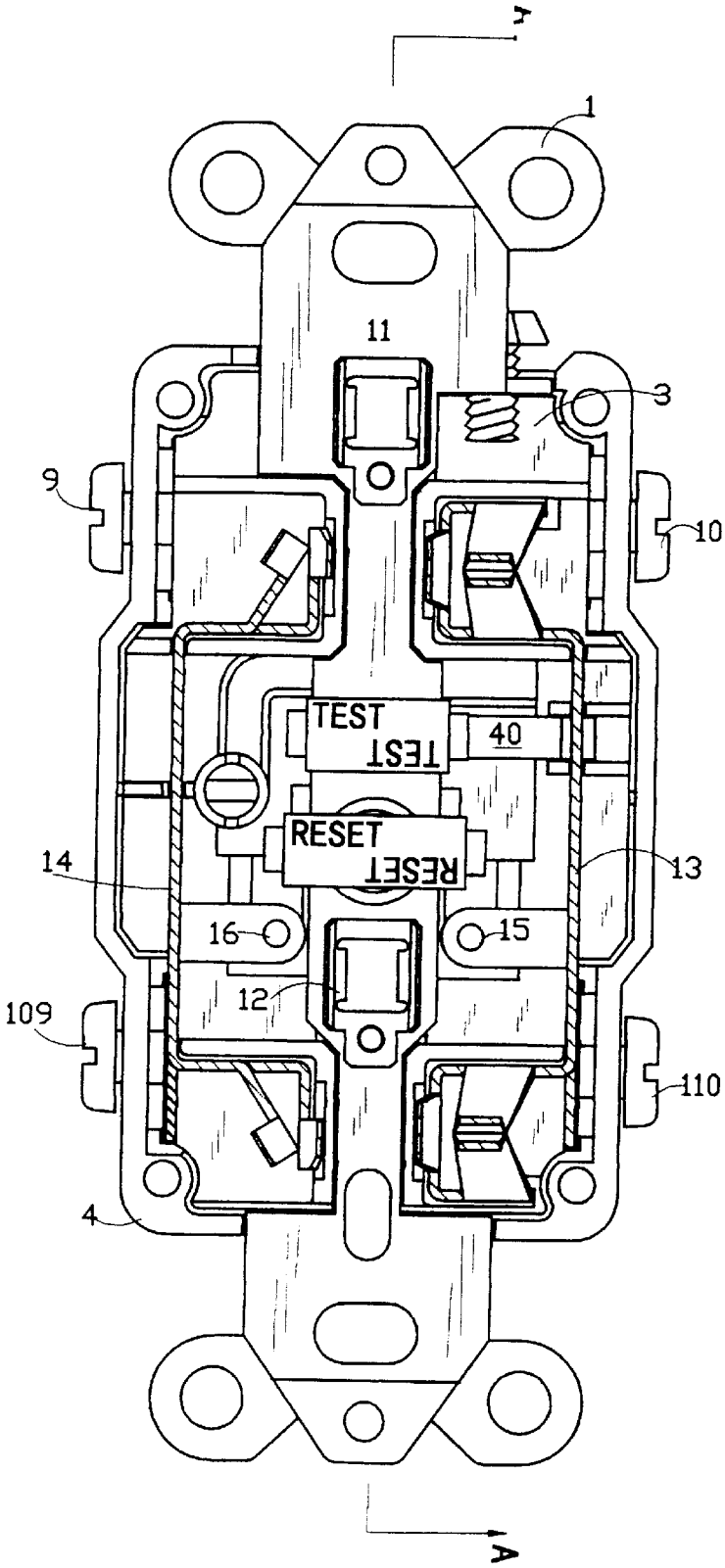
FIG. 2 is an elevational view of the receptacle of the present invention therein the upper housing is cut away.
Figure 3:
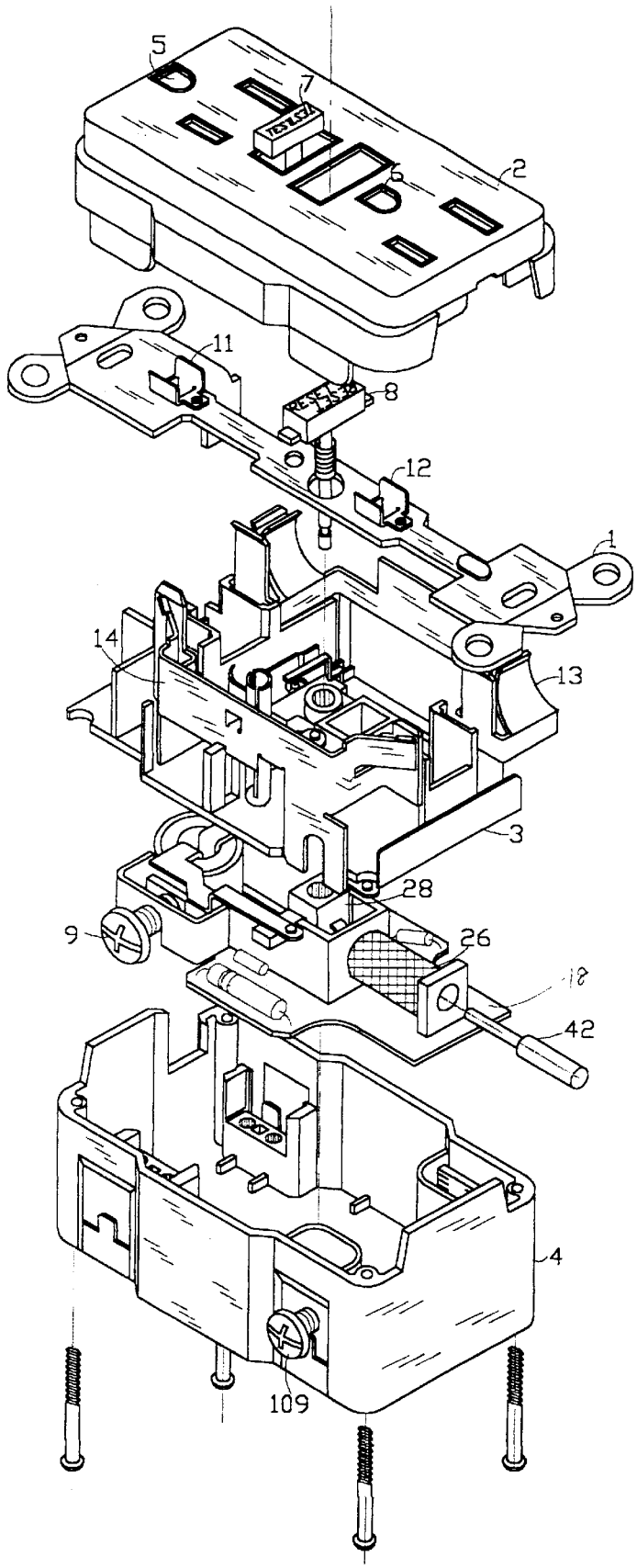
FIG. 3 is an exploded perspective schematic diagram of the receptacle of the present invention.

As shown in FIGS. 2 and 3, a metal mounting plate 1 is mounted on the upper housing 2. Through the holes on the upper housing 2, the grounding contacts 11 and 12 on the metal mounting plate 1 are connected with their respective lead-out grounding prongs of the power-out socket 5, 6. At the two sides of the supporter 3 are respectively disposed a pair of power-output metal conductors 13, 14. Thereon are respectively disposed a pair of power-output contacts 15, 16 which are connected to their respective phase line inserting apertures of the power-output sockets 5, 6 positioned on the upper housing 2. The power-output metal conductors 13, 14 also are connected with their respective power-output connecting screws 110, 119 of the ground fault interruption receptacle. Furthermore, a metal testing sheet 40 is transversely disposed between the lower part of the power-output metal conductor 13 and the test button 7 (as shown in FIG. 5).

Figure 4:
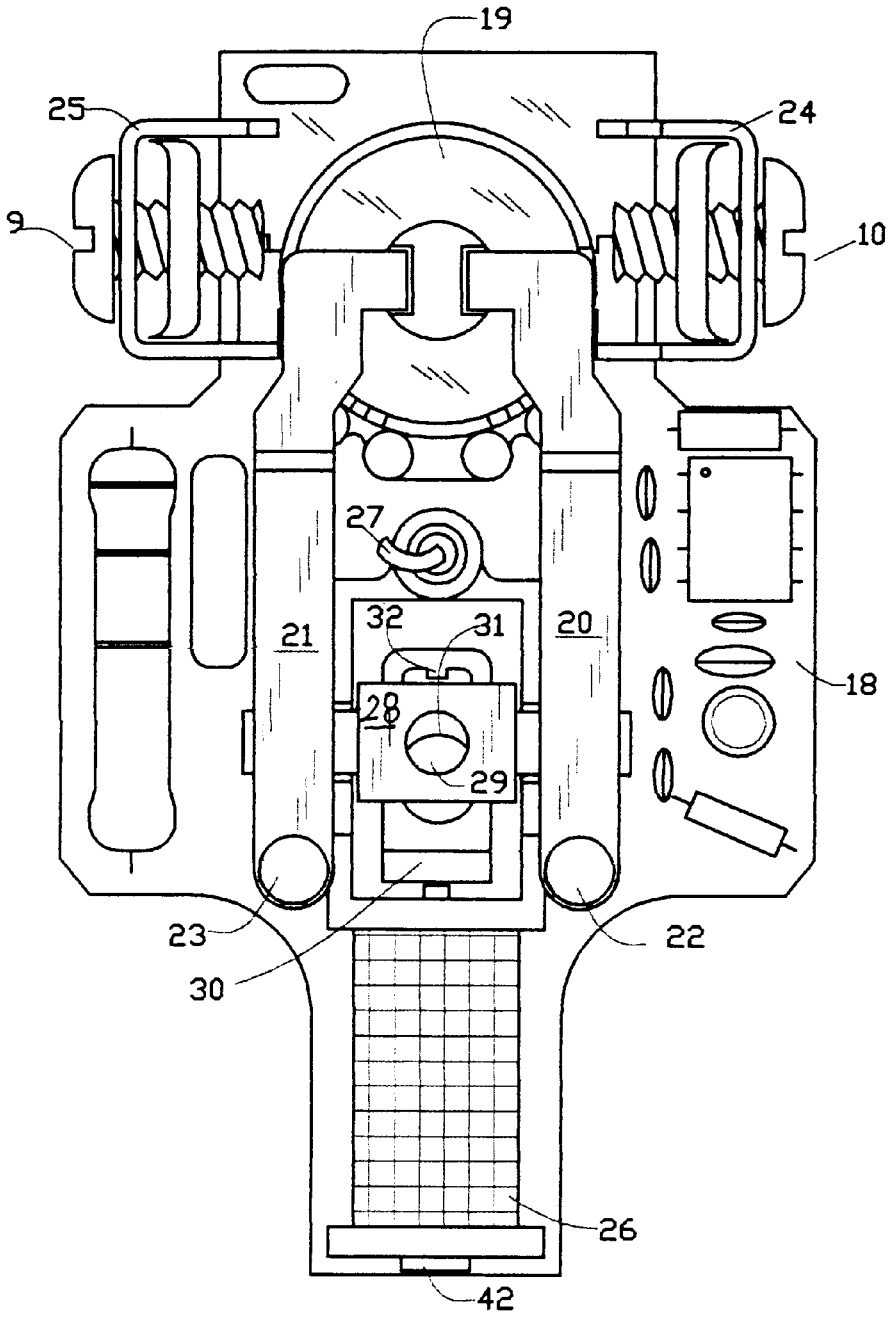
FIG. 4 is a schematic diagram of printed circuit board of the receptacle of the present invention.

The lower holder 4 is used for containing the middle supporter 3 and the printed circuit board 18 as shown in FIG. 4. At the two sides of the lower holder 4 are symmetrically disposed a pair of power-input connecting screws 9 (HOT) and 10 (WHITE), and a pair of the power-output connecting screws 109 (HOT) and 110 (WHITE).

Figure 5:
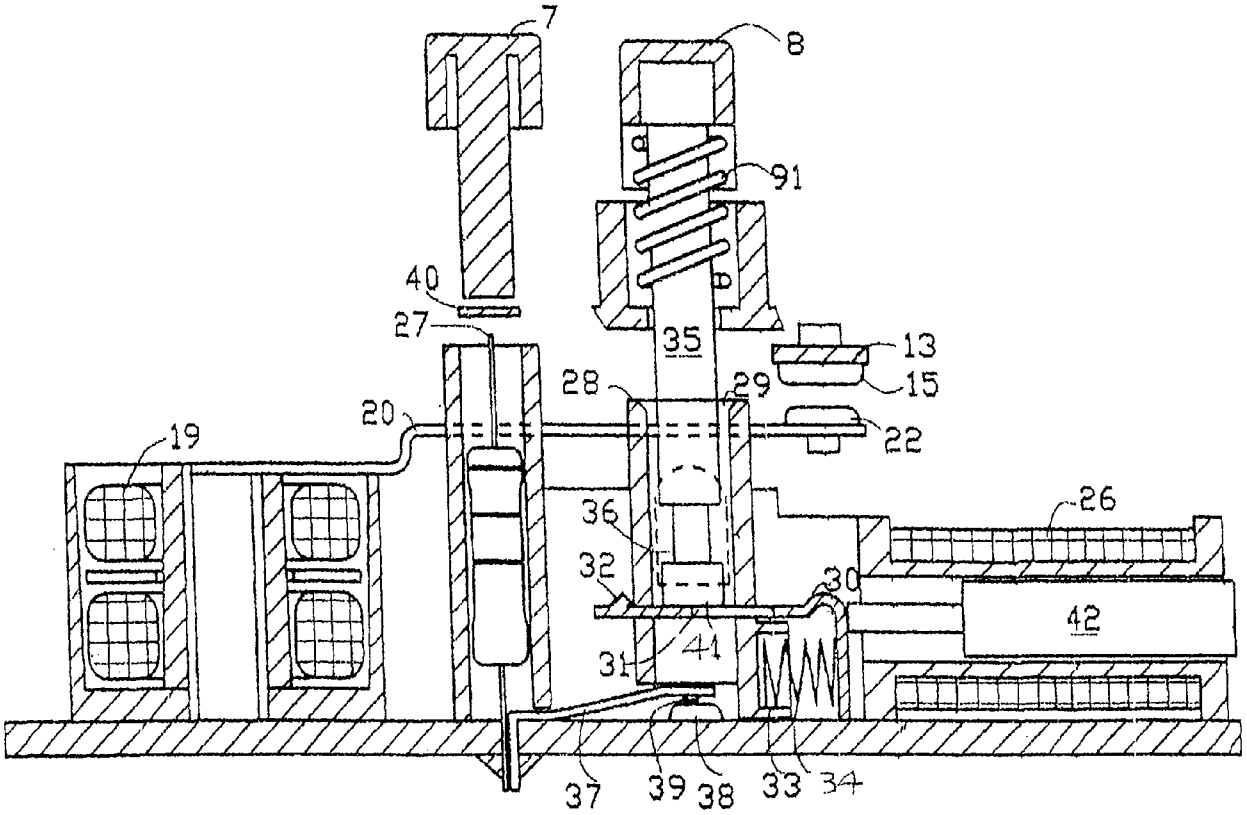
FIG. 5 is a sectional view of the receptacle of the present invention along the sectional line A—A in FIG. 2, a principle diagram to illustrate how to prevent power-input and power-output from being electrically connected.

As shown in FIGS. 3, 4 and 5, the printed circuit board 18 is arranged within the lower holder 4. And disposed on the printed circuit board 18 are a differential transformer 19, a pair of the power-input resilient metal sheets 20, 21, a solenoid 26 within which a movable iron core 42 is inserted, a reset guide member 28 and a flat spring type of resilient off locking switch 37.

A pair of contacts 22, 23 are disposed respectively at one end of each of the power-input (i.e. power source side and similarly hereinafter) resilient metal sheets 20 and 21. Through the differential transformer, the power-input connecting screws 9 and 10 are connected respectively with the another end of each of the power-input resilient metal sheets 20 and 21 by power-input connectors 24 and 25.

On the printed circuit board 18 further is disposed the solenoid 26 in which a movable iron core 42 inserted. Under the simulate test button 7 of the upper housing 2 a testing resistor 27 is disposed. A terminal of the resistor is connected to natural phase line of the power source.

The reset guide member 28 is positioned under the reset button 8 and between power-input resilient metal sheets 20 and 21. On the top of the reset guide member 28 is formed a longitudinally central through hole 29. Under the bottom end of the reset guide member 28 is disposed an L-shaped movable latch member 30. The L-shaped movable latch member 30 is made of metal material. At the middle of the horizontal part of latch member 30 is formed a through hole 31, and at left end of latch member 30 is disposed a position-limiting pin 32 used. At one side, which is toward the vertical part of the latch member 30, of the reset guide member 28 is formed a circular shape recess 33 used. The spring member 34 is placed between the bottom of the circular shape recess 33 and the vertical part of the latch member 30. Through the central aperture 31 of the latch member 30, a locking guide plunger 35 is disposed within the reset guide member 28. At the bottom end of the locking guide plunger 35 is formed a flat surface 41. A part of the spring member 91 is on the top of the locking guide plunger 35 and the another part of the spring member 91 is embedded within reset button 8. Near the bottom of the locking guide plunger 35 is formed a locking recess 36.

Figure 8:
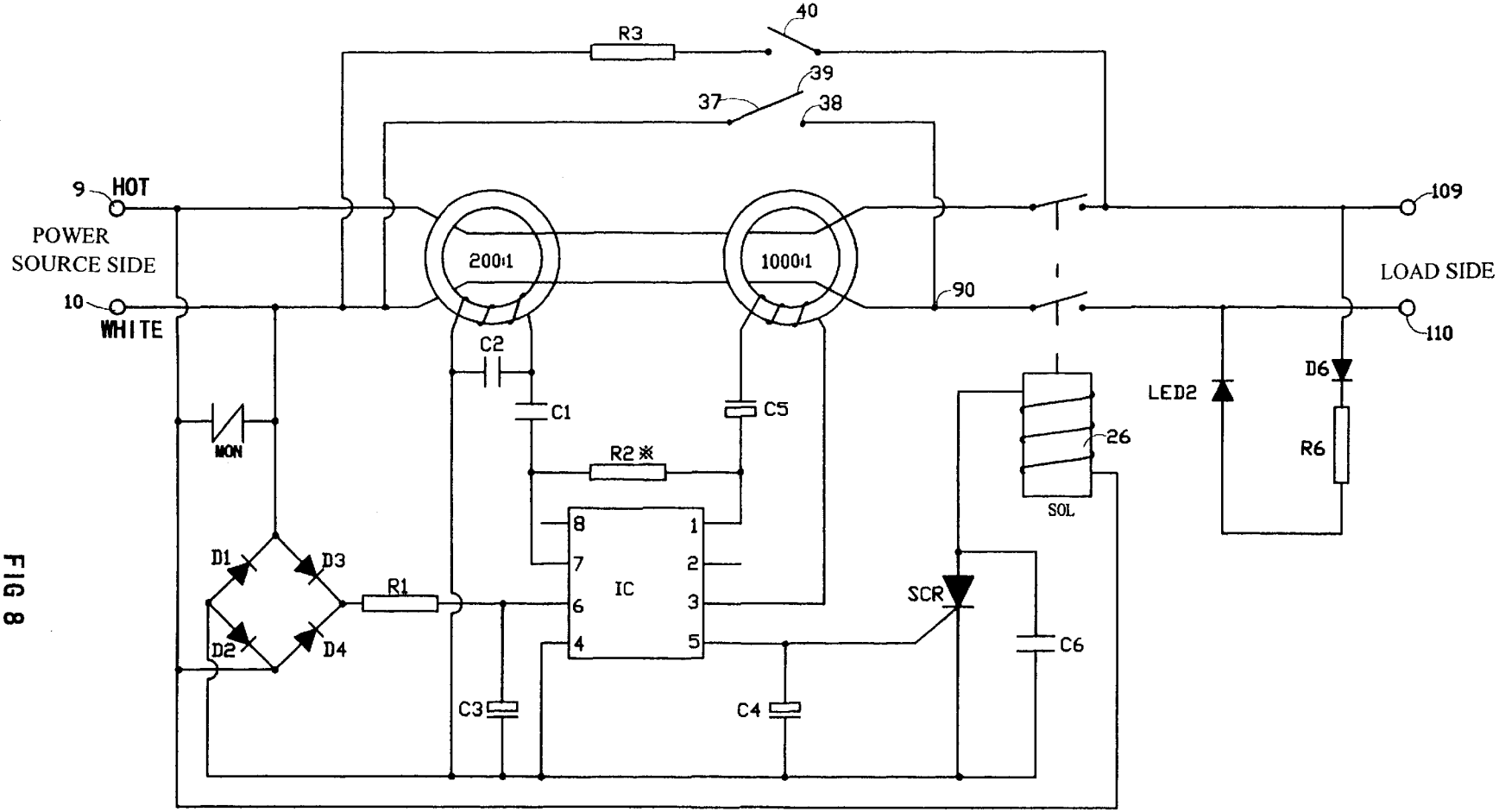
FIG. 8 is a principle diagram of the printed circuit board of the ground fault interruption receptacle of the present invention.

The resilient off locking switch 37, which is made of metal material, is positioned between the preset guide member 28 and the printed circuit board 18. One end of the resilient off locking switch 37 is welded or soldered on the printed circuit board 18, and its another end has a protruded circular spot 39 formed by punching and positioned corresponding contact 38 thereunder. As shown in FIG. 8, through the differential transformer 19, both ends of the resilient off locking switch 37 are respectively connected to the neutral line connector of power-input (WHITE) and the neutral line connector of power-output (WHITE) in order to detect whether a certain component in the receptacle is damaged and whether the power-input and the power-output connector are confused each other.

Figure 6:
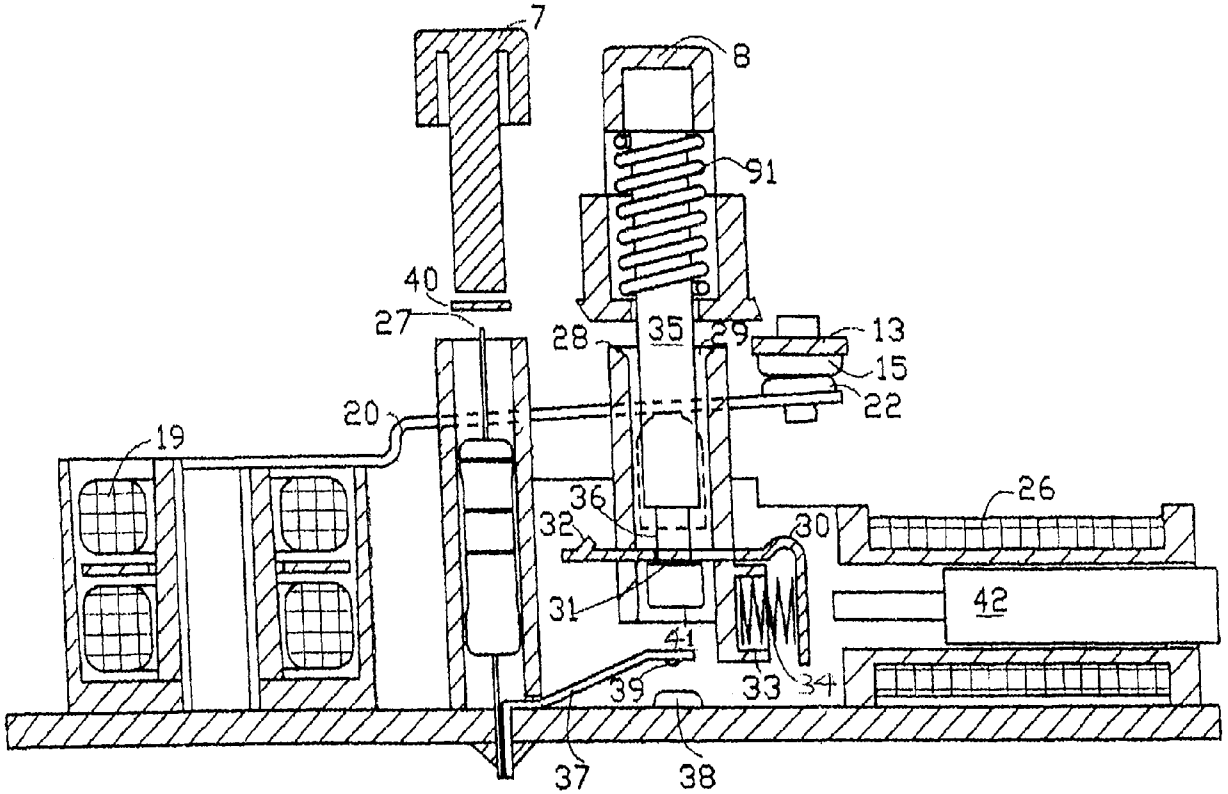
FIG. 6 is a sectional view of the receptacle of the present invention along the sectional line A—A in FIG. 2, a principle diagram to illustrate how to set up the electrical connection between power-input and power-output when reset button is pushed down.

FIGS. 5 and 6 are the principle diagrams for schematically illustrating the accomplishment of the ground fault interruption and the accomplishment of the electric connection between power input and power output with the receptacle of the present invention.

As shown in FIGS. 5, 6 and 8, when the receptacle of the present invention is in normal operation state, the locking guide plunger 35, which is connected with the reset button 35, will move downward due to the depression of reset button.

Along with the movement of the locking guide plunger 35, the reset guide member 28 moves downward so that the locking guide plunger 35 causes its bottom end flat surface 41 to press on the latch member 30. Thus the downward movement of the reset guide member 28 causes the contacts 38 and 39 of the resilient off locking switch to be conducted. Because of one end of the resilient off locking switch 37 through the differential transformer, the closing of the resilient off locking switch 37 enables the differential transformer 19 to be able to detect whether the fault current occurs, and to generate a voltage output once the fault current is detected. This voltage output is applied to an integrated circuit IC and causes it to send out a control signal, by which the silicon controlled rectifier SCR is conducted. Then the solenoid 26 generates a magnetic field for current coming from silicon controlled rectifier SCR flows through the solenoid 26. The magnetic force generated by the magnetic field pushes the iron core 42 moving and striking against the latch member 30 to move toward left. Following this movement of the latch member 30, the downward movement of the locking guide plunger 35 causes its bottom part inserting into the central aperture 31 of the latch member 30. In the meantime, the flat spring sheet of the resilient off locking switch 37 will jump up because its resilience and causes its contact 39 and the contact 38 to be in a disconnecting state for the locking guide member 28 loose its depression from the resilient locking switch 37. In the case of the disconnection of the contacts 38 and 39, the magnetic field eliminates because of no current flowing through the solenoid 26. The resilience of the spring member 34, which is positioned between the vertically bent part of the latch member 30 and reset guide member 28, pushes the latch member 30 to move back. Because of the backing movement of the latch member 30 and the jumping up of the flat spring sheet of the off locking switch 37, the locking guide plunger 35 slides downward and enable its bottom part inserting into the central aperture 31 of the latch member 30. Then locking guide plunger 35 is locked because of the horizontal part of the latch member 30 inserting into the circular shape recess 33. Also because the spring 91 is released from the top of the locking guide plunger 35 is released, the reset guide member 28 moves upward. In this case, the contact 22 of the power-input resilient metal sheet 20 will be connected with the power-output contact 15, and the contact 23 of the power-input resilient metal sheet 21 will be connected with the power-output contact 16. Then the electric connection between power-input and power-output is accomplished.

FIGS. 5 and 8 are also two schematic principle diagrams to illustrate the connection principle between the power-input and the power-output connector of the ground fault interruption receptacle under condition that a certain element or member for power transmission in the receptacle is damaged and/or any confusion between the power-input and the power-output screw is occurred. When any component in the receptacle, for example the capacitor C5, is damaged, the silicon controlled rectifier SCR is unable to conduct current even though the reset button is repressed and the contacts 38 and 39 of the off locking switch 37 are closed. Thus no magnetic field will be generated because of no current, which comes from silicon controlled rectifier SCR, flowing through the solenoid 26. Subsequently, the iron core 42 cannot move and the strike the latch member 30. In such a case, the flat surface 41 formed at the bottom end of the locking guide plunger 35 is pressed on the horizontal part of the latch member 30. Then the flat spring sheet of the off locking switch 37 can not jump up and the reset guide member 28 can not move upward. Thus it enables the contacts 22, 23 disposed on their respective power-input resilient metal sheets 20, 21 and the contacts 15, 16 disposed on their respective power-output metal conductors 13, 14 continuously being in disconnecting state. Now turning to FIG. 8, in case that an error is made in line (or wire) connection, namely the phase and the neutral lines are incorrectly connected to their respective connectors 109 and 110 for the load side. But the silicon controlled rectifier SCR still can not be conducted and no current flows through the solenoid 26, even though the ground fault interruption receptacle itself is in a good condition and the contacts 38, 39 of the resilient off locking switch 37 contact each other. Thus iron core 42 cannot move and strike the latch member 30 because there is no magnetic force acting on it. Under such condition, the flat surface 41 formed at the bottom end of the locking guide plunger 30 will be pressed on the horizontal part of the latch member 30. Then the flat spring sheet of the resilient off locking switch 37 is unable to jump up and the reset guide member 28 also cannot move upward. The contacts 22, 23 disposed on their respective power-input resilient metal sheets 20, 21 and the contacts 15, 16 disposed on their respective power-output metal conductors 13, 14 will keep continuously in opening state. Then the power-input and power-output are electrically disconnected.

Figure 7:
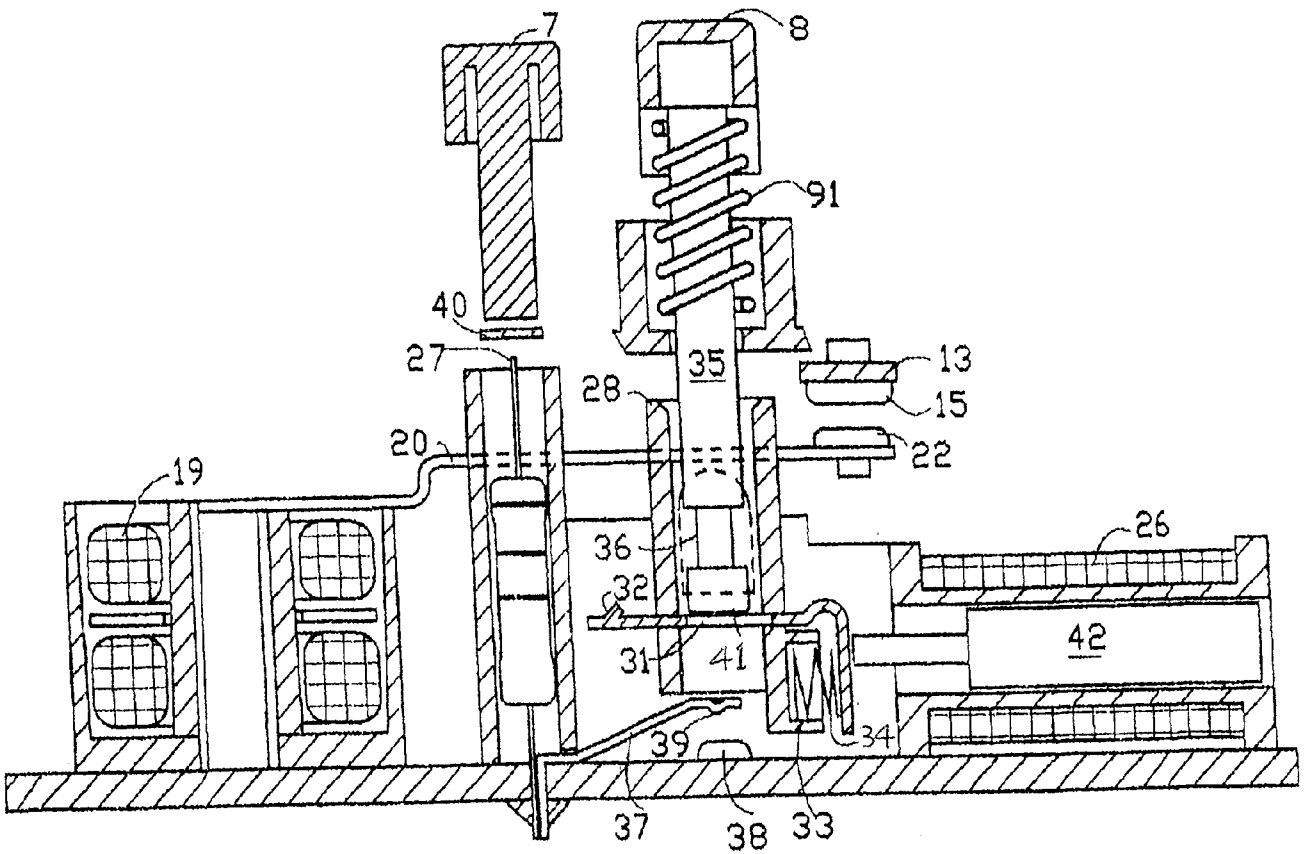
FIG. 7 is a sectional view of the receptacle of the present invention along the sectional line A—A in FIG. 2, a principle diagram to illustrate the accomplishment of the electrical disconnection between power-input and power-output once the fault current is detected.

As shown in FIGS. 7 and 8, if any fault current is detected by the differential transformer 19 that is used for the present invention, then the silicon controlled rectifier SCR will be conducted. As a result, the solenoid 26 has current flowing through it and generates a magnetic field. Under the action of magnetic force, the iron core 42 is pushed moving and striking against the vertical bent part of the latch member 30. Along with movement of the latch member 30, the reset locking guide plunger 35 will slide out from the central aperture 31 that is arranged at the horizontal part of the latch member 30. Along with the reset button 8 jumping up due to the action of a pushing force generated by the spring member 91, which is worn over the locking guide plunger 35, the reset guide member 28 drops down. The contacts 22, 23 disposed on their respective power-input resilient metal sheets 20, 21 and the contacts 15, 16 disposed on their respective power-output metal conductors 13, 14 will separate. Then the electric connection between the power-input and the power-output is interrupted.

In case that the user desires to interrupt the connection between power-input and power-output of the ground fault interruption receptacle, he/she may depress down the simulation test button. The metal testing sheet 40 will be conducted with the testing resistor 27 so that the differential transformer begins to detect fault current and generates a voltage output applied across an integrated circuit IC once the fault current is detected. Then the solenoid 26 generates a magnetic field for current coming from silicon controlled rectifier SCR flows through it. The magnetic force generated by this magnetic field will pushes the iron core 42 moving and striking against the vertically bent part of the latch member 30. Under this condition, the latch member 30 is moved and the locking recess 36 on the lower part of the locking guide plunger 35 slips out from the central aperture 31 of the latch member 30. Driven by the spring on the top of the locking guider plunger 35, the reset button 8 jumps up. Then the reset guide member 28 drops down, so that the contacts 22, 23 disposed on their respective power-input resilient metal sheets 20, 21 and the contacts 15, 16 disposed on their respective power-output metal conductors 13, 14 are separated. As a result, the electric connection between the power-input and the power-output is interrupted.

What is claimed is:

1. A new and improved receptacle comprising:

an upper housing 2, a middle supporter 3 and a lower holder 4;

a metal mounting plate 1 disposed between said middle supporter 3 and said upper housing 2;

a printed circuit board 18, thereon are disposed a differential transformer 19, a reset guide member 28;

a solenoid 26 within which an iron core is inserted;

a flat spring type of resilient off locking switch disposed between the reset guide member 28 and said printed circuit board 18;

a longitudinally central through hole 29 formed within said reset guide member 28;

a movable L-shaped metal latch member 30 disposed under said reset guide member 28, and a position-limiting pin 32 for limiting the displacement of said L-shaped metal latch member 30 disposed at one end of said latch member 30;

a central aperture 31 formed at the horizontal part of said latch member 30;

a locking guide plunger 35, a flat surface 41 formed at the bottom end of said locking guide plunger 35, and a locking recess 36 formed near the under part of said locking guide plunger 35;

a spring member 91 worn over the upper part of said locking guide plunger 35, wherein one end of said spring member 91 inserted within a reset button 8; and a contact 38 placed on the circuit board corresponding to a protruded circular spot 39 on the off locking switch;

thereby through said differential 19, both ends of said off locking switch 37 are connected to their respective neutral lines of power-input connectors 9, 10 and power-output connectors 109, 110.

2. The receptacle as set forth in claim 1, wherein:

two sets of female power-output sockets 5, 6, a simulation test button and said reset button all are disposed on said upper housing 2.

3. The receptacle as set forth in claim 1, wherein:

grounding contacts 11 and 12 are disposed on said metal mounting plate 1, wherein grounding prongs of female power-output sockets 5, and 6 respectively connect with said grounding contacts 11 and 12 through a relevant hole on said upper housing 2.

4. The receptacle as set forth in claim 1, wherein:

a pair of power-output metal conductors 13, 14 are respectively disposed at two sides of said supporter 3, wherein one of the ends of said power-output metal conductors 13, and 14 are respectively connected with said power-output connectors 109 and 110, wherein the another one of the ends of said power-output metal conductors 13, and 14 are disposed with power-output contacts 15 and 16.

5. The receptacle as set forth in claim 1, wherein:

through said differential transformer, a pair of power-input resilient metal sheets 20 and 21 are respectively disposed at the two sides of said longitudinally central through hole 29 of said reset guide member 28 and respectively connected with said power-output connectors 109 and 110; corresponding to power-output contacts 15 and 16 disposed on the relevant ends of power-output metal conductors 13, and 14 within said middle supporter 3, contacts 22 and 23 are respectively disposed on said power-input resilient metal sheets 20 and 21.

6. The receptacle as set forth in claim 1, wherein:

a metal testing sheet 40 is transversely disposed between power-output metal conductors 13, 14 and a simulation test button 7.

7. The receptacle as set forth in claim 1, wherein:

a circular shape recess 33 used for containing a spring member 34 is formed at one side, which is toward a vertical part of the latch member 30, of the reset guide member 28.

8. The receptacle as set forth in claim 1, wherein:

a testing resistor 27 is disposed under a simulation test button 7; one end of said testing resistor 27 is connected with a neutral line of power-input.

* * * * *